United States Patent [19]

Browning et al.

[11] Patent Number: 4,870,979

[45] Date of Patent: Oct. 3, 1989

[54] SMOKER'S PIPE

[75] Inventors: Shane C. Browning, Newtownabby; Robert Carlisle, Larne; Alexander H. Wright, Belfast, all of Ireland

[73] Assignee: Gallaher Limited, England

[21] Appl. No.: 138,595

[22] Filed: Dec. 28, 1987

[30] Foreign Application Priority Data

Dec. 31, 1986 [GB] United Kingdom ..... 8631069

[51] Int. Cl.[4] ..... A24F 5/00

[52] U.S. Cl. ..... 131/196; 131/226

[58] Field of Search ..... 131/196, 195, 203, 220, 131/226, 222, 214

[56] References Cited

U.S. PATENT DOCUMENTS

| | | | |
|---|---|---|---|
| 2,138,322 | 11/1938 | Douglas | 131/196 |
| 2,485,222 | 10/1949 | Vermilyea . | |
| 2,718,892 | 9/1955 | Holderman | 131/196 |
| 3,213,469 | 7/1980 | Ramsay . | |
| 3,422,821 | 1/1969 | Calkins | 131/196 |
| 3,645,274 | 2/1972 | Lebert | 131/226 |
| 3,695,276 | 10/1972 | Coale . | |
| 3,828,799 | 8/1974 | Beam . | |
| 4,203,456 | 5/1980 | Miller . | |
| 4,290,437 | 9/1981 | Smith | 131/191 |
| 4,362,169 | 12/1982 | Calkins . | |
| 4,577,645 | 3/1986 | Calkins . | |

FOREIGN PATENT DOCUMENTS

| | | | |
|---|---|---|---|
| 770077 | 11/1971 | Belgium . | |
| 26992 | 12/1923 | France | 131/196 |
| 634146 | 2/1928 | France . | |
| 758315 | 11/1933 | France | 131/225 |
| 1242890 | 8/1960 | France . | |
| 628507 | 3/1982 | Switzerland . | |
| 1897 | of 1906 | United Kingdom | 131/199 |
| 22630 | of 1911 | United Kingdom . | |
| 135503 | 3/1920 | United Kingdom . | |
| 2532 | 5/1931 | United Kingdom | 131/226 |
| 1458683 | 12/1976 | United Kingdom . | |
| 1597106 | 9/1981 | United Kingdom . | |

*Primary Examiner*—Richard J. Apley
*Assistant Examiner*—J. Welsh
*Attorney, Agent, or Firm*—Andrus, Sceales, Starke & Sawall

[57] ABSTRACT

A smoker's pipe has a plastics bowl (17) and stem (16) and, within the bowl, a ceramic liner (18) having a flange (19) which overlies the rim of the bowl, and is secured thereto by a resilient ring (29) of adhesive.

11 Claims, 3 Drawing Sheets

SMOKER'S PIPE

Traditionally, the bowl and stem of a smoker's pipe are formed by shaping wood, such as briar root, or meerschaum, or sometimes a combination of a wooden bowl with a closely fitting meerschaum lining. The shaping of the essential parts of a pipe from such materials makes the pipes unduly expensive. The object of the invention is to create a pipe, which can be manufactured simply, and possibly even cheaply enough to be considered a disposable item, by the use particularly of a moulded plastics part or parts. It is unacceptable to make the bowl of the smoker's pipe wholly from a plastics material because the intense heat from the burning charge of tobacco is liable to soften and melt the plastics material, or to char the plastics material with the production of potentially toxic fumes which will be inhaled by the smoker.

One solution to this problem, as exemplified in U.S. Pat. No. 3,422,821, is to line a moulded plastics pipe bowl with a cup-shaped refractory liner which is arranged to hold the charge of tobacco, and which has, in its bottom, a hole leading via a smoke duct through the pipe stem to a mouthpiece. However, in the particular pipe disclosed in the U.S. specification, the upper rim of the liner is located wholly within the inner periphery of the plastics bowl. As a result, when a flame is used to light the pipe, it will play on the upper rim of the plastics bowl, leading to the aforementioned problems of softening or charing. Furthermore, it is difficult for sufficient heat to be conducted or radiated away from the liner to maintain a cool smoke. In fact, the specification discloses the provision of air ventilating passages between the bowl and liner, or the provision between the bowl and liner of an insulating interliner but this is primarily for the purpose of avoiding overheating of the bowl with consequential discomfort to the smoker who holds the pipe in his hand by the bowl. Also, it is proposed in the U.S. specification to secure the liner in the plastics bowl by means of a spring washer and an externally screw threaded ring which overlies the upper rim of the liner and screws into complementary screw threads within the top of the bowl. This is complicated and unsatisfactory, in that it introduces metallic components which exacerbate problems associated with differential thermal expansion of the bowl and liner.

U.S. Pat. No. 2,138,322 discloses a smoker's pipe of the kind, hereinafter referred to as of the kind described, comprising a moulded plastics bowl and stem and, within the bowl, a refractory cup-shaped liner having at its bottom a hole which leads via a smoke duct through the stem to a mouthpiece, the upper edge of the liner being formed with an integral radially outwardly projecting flange which overlies an upper rim of the bowl, substantially the whole of the liner beneath the flange being held out of direct contact with the bowl with an annular thermally insulating zone therebetween. However, in the particular example described in that U.S. specification, the liner is a friction fit with the bowl. This has the disadvantages that a tight direct fit is essential and this inevitably involves good thermal contact and hence the danger of degradation of the plastics material from which the bowl is made. Also differential thermal expansion of the bowl and liner will cause problems with the security of the connection between the liner and bowl. Subsidiary problems with the particular pipe disclosed are that the liner flange does not completely cover the upper rim of the bowl, so that overheating of the plastics material during lighting of the pipe is possible; and that the axis of the bowl and pipe are inclined at an acute angle to that of the smoke duct through the stem so that smoke emanating through holes in the bottom of the liner impinges immediately and directly on the plastics material at the bottom of the bowl, leading to further danger of hot spots and plastics degradation.

In accordance with the present invention, a smoker's pipe of the kind described is characterized in that the liner is located relatively to the bowl, and the upper end of the zone is sealed, by a ring of resilient material.

A pipe of this construction may be manufactured and assembled simply, and cheaply enough to be disposable from a moulded plastics bowl and stem component with or without a separate mouthpiece, and a moulded refractory liner, made of a ceramic material, such as porcelain, which is fitted in the bowl with its flange overlying the upper rim of bowl. The provision of the flange provides a significantly large exposed surface of the refractory material at the upper end of the bowl, from which a significant amount of heat can be radiated from the liner to avoid overheating of the plastics bowl. The flange of the liner preferably completely overlies the upper rim of the plastics bowl and consequently protects this portion of the bowl from the adverse effects of a flame used for lighting a charge of tobacco in the liner. The fact that the majority, indeed virtually all, of the liner beneath the flange is held out of direct contact with the surrounding wall of the bowl, possibly with an interposed interliner of insulating material, such as may result from heating, in use, of a coating of sodium silicate on the outside of the liner, but preferably with a completely free annular air space between the liner and bowl, additionally reduces the transmission of heat to the bowl, which would otherwise make it uncomfortable to handle and give rise to potential toxicology problems.

The ring of resilient material provides the dual role both of locating the liner, either in part or entirely, relatively to the bowl, and of sealing the upper end of the annular thermally insulating zone between the liner and bowl to avoid air being drawn in around the liner when the smoker sucks on the mouthpiece. The resilience of the ring minimizes assembly problems resulting from manufacturing tolerances of the liner and bowl, but particularly allows differential thermal expansion of the liner and bowl without the creation of unacceptable stresses.

Although the majority, indeed virtually all, of the liner beneath the flange should be out of direct contact with the bowl, it may be desirable to provide one or more complementary lugs and notches in the liner and bowl, preferably immediately beneath the flange and adjacent to the upper rim of the bowl, to locate one angularly relatively to the other, particularly if the bowl and liner are asymmetric about the axis of the liner and assembly in the correct relative angular orientation is necessary. This will be so if the axis of the bowl and liner and the axis of the adjacent end of the smoke duct intersect at an upwardly facing included obtuse angle, which is desirable if hot smoke leaving the liner hole is to enter the smoke duct without directly and immediately impinging, and producing a hot spot, on the wall of the plastics bowl and stem. One or more spacer lugs may also or alternatively be provided immediately beneath the flange or adjacent to the upper edge of the bowl to centre the liner in the bowl and inhibit tilting of the liner relatively to the bowl.

The pipe liner may be arranged to be charged with a preformed plug of smoking material, such as a wrapped plug of natural tobacco or tobacco sheet. The pipe may be sold with the plug in situ, or separate plugs might be made available for filling or refilling the pipe. In order to provide a supply of air for nourishing the combustion of the tobacco, both when the charge of tobacco is to be lit, and in order to keep the charge alight, the inner surface of the liner may be provided around its circumference, at least at its upper part, with a plurality of axially extending ribs. In practice the gaps between the ribs will be incompletely filled by the tobacco charge so that the grooves between the ribs will provide additional air supply. In order to receive a preformed plug of smoking material, the inner surface of the liner may be downwardly tapered, and when the ribs are provided, a notional inscribed surface of contact with the radially innermost portions of the ribs preferably also tapers downwardly. Consistent with this arrangement, each of the ribs may also taper, preferably both in the circumferential and radial direction of the liner, in the downward direction.

The bowl and stem are preferably moulded either from a high temperature unfilled plastics material, or from a relatively inexpensive plastics material with adequate high temperature resistance. The flange of the liner may be bonded to the upper rim of the bowl by a high temperature adhesive, such as a silicone rubber adhesive, which provides the resilient ring. Improved strength of adhesion and reduced tendency to outward extrusion of adhesive on assembly may be obtained to providing an annular recess for the adhesive in, but spaced from the outer periphery of the upper surface of the rim of the plastics bowl facing the underside of the flange of the pipe liner. Alternatively the resilient ring may be provided by a preformed high temperature O-ring compressed between, and located in grooves in, the bowl and liner adjacent to the upper ends thereof. However this may be impracticable unless the liner and bowl are substantially circularly symmetrical, or at least have axes generally normal to the planes of the bowl rim and liner flange.

The stem, or mouthpiece if a separate mouthpiece is provided, or the stem and mouthpiece at their junction, may incorporate a myria or other filter plug to absorb moisture and filter the main stream smoke drawn by the smoker through the stem and mouthpiece.

Two examples of a pipe constructed in accordance with the present invention are illustrated in the accompanying drawings, in which.

Figure 1:
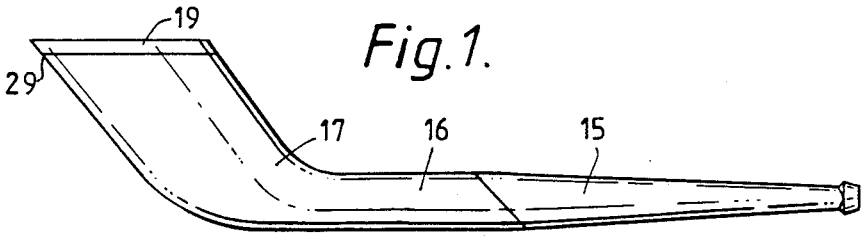
FIG. 1 is a side elevation.

The pipe of FIGS. 1 to 11 comprises a moulded plastics mouthpiece 15, connected by a conventional spigot and socket joint to a stem 16 of an integrally moulded plastics stem and bowl 17. Fitted within the bowl 17 is a moulded porcelain cup-shaped liner 18 having a flange 19 which overlies and is bonded to the upper rim 20 of the bowl 17 by a silicone rubber adhesive, which sets to form a resilient ring 29, and which is resistant to a temperature of up to 130° C. to which it will be subjected in use. Mutual angular orientation between the liner and bowl is assured by engagement of diametrically opposed lugs 21 on the liner beneath the flange 19 with complementary recesses 22 in the upper edge of the bowl. These lugs 21, and also two diametrically opposed lugs 21A, centre the liner in the bowl and inhibit tilting of the liner which might bring the bottom of the liner into proximity, or even contact, with the bowl. As shown, the lugs 21 and recesses 22 are opposed sideways across the pipe bowl and the lugs 21A are opposed in the fore and aft direction. This arrangement could be reversed, or even amplified with additional lugs 21 and/or 21A provided that the necessary fore and aft tilting, sideways tilting, and rotational, degrees of freedom are limited. The remainder of the outer surface of the bowl is spaced by an annular air gap 23 from the surrounding wall of the bowl 17. The inner surface of the upper portion of the liner is formed with a ring of downwardly extending downwardly tapering ribs 24.

The bottom of the liner is formed with a hole 25 which leads from the burning chamber within the liner to a smoke duct 26 through the stem, to a corresponding duct within the mouthpiece 15.

The upwardly facing obtuse angle included between the axes A and B of the bowl and liner and of the stem, respectively, provides a significant spacing between the hole 25 in the bottom of the liner and the part 30 of the plastics wall where the bowl 17 merges into the stem 16. As a result, the smoke stream from the hole does not impinge directly and immediately on the wall part 30. For example, experiments show that increasing the spacing of the hole 25 and wall part 30, where it intersects the axis A, from 9 mm to 12 mm reduces the hot spot temperature from 250° C. to 210° C. This is critical if cheap, temperature sensitive plastics materials are to be used for the bowl and stem.

Figure 4:
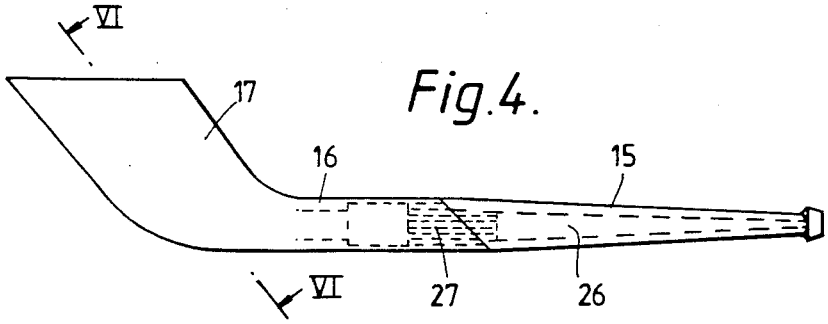
FIG. 4 is a side elevation of the plastics parts of the pipe.
Figure 5:
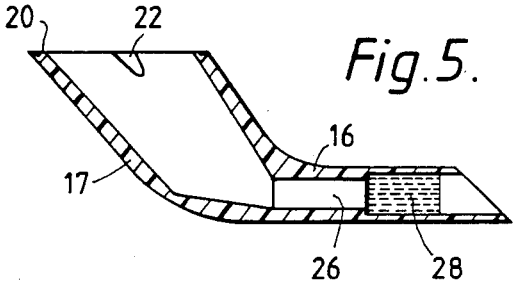
FIG. 5 is a section taken on the line V—V in FIG. 3.
Figure 6:
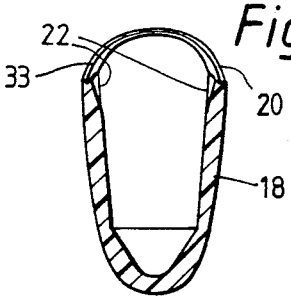
FIG. 6 is a section taken on the line VI—VI in FIG. 4.
Figure 7:
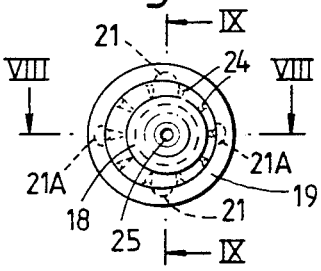
FIG. 7 is a plan view of the liner.
Figure 8:
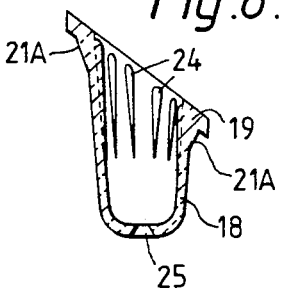
FIG. 8 is a section taken on the line VIII—VIII in FIG. 7.
Figure 9:
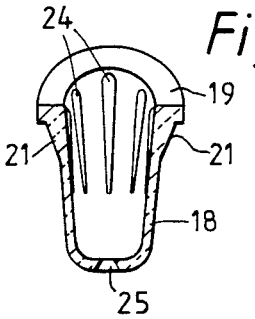
FIG. 9 is a section taken on the line IX—IX in FIG. 7.
Figure 10:
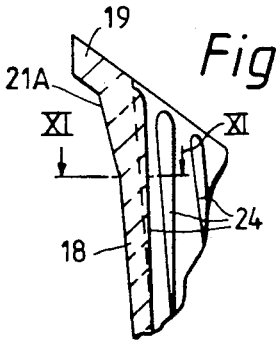
FIG. 10 is a partial vertical section through part of the liner.
Figure 11:
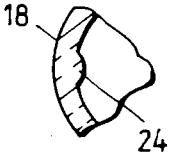
FIG. 11 is a section on the line XI—XI in FIG. 10.

The smoke ducts through the stem and/or mouthpiece may be fitted with a filter plug in the positions shown at 27 in FIG. 4 or 28 in FIG. 5.

Figure 2:
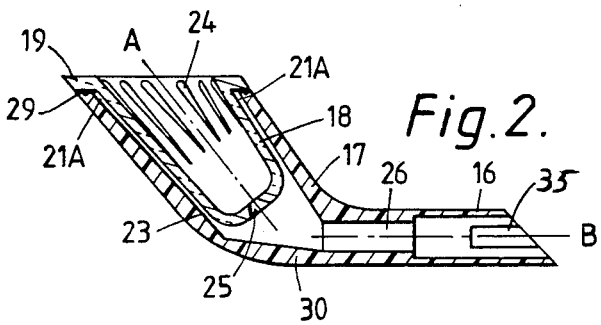
FIG. 2 is a vertical axial section through part of the pipe.
Figure 3:
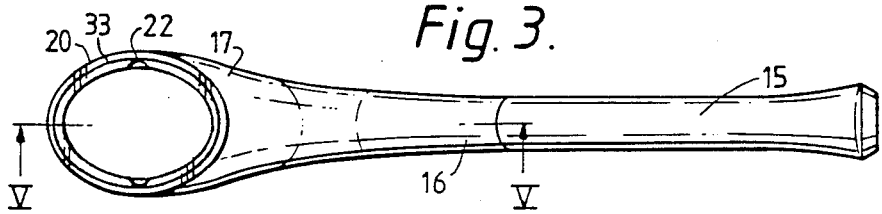
FIG. 3 is a plan of the plastics parts of the pipe.

The stem and mouthpiece can be provided with one or more keys and complementary keyways 35 (as shown in FIG. 2) to prevent misalignment of bowl and mouthpiece and inhibit disassembly and tampering with the filter.

Figure 12:
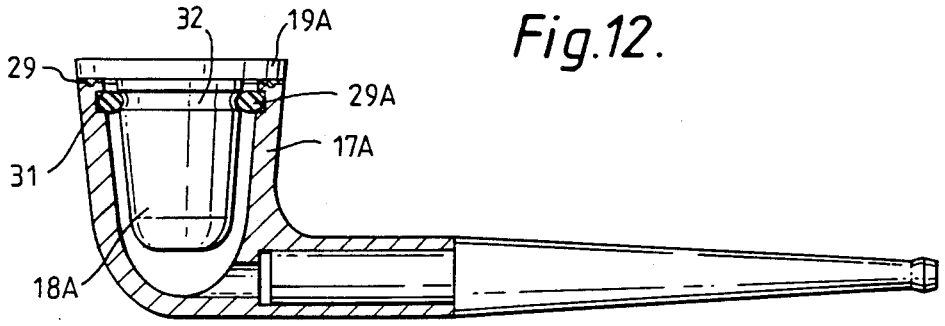
FIGS. 12, 13 and 14 are vertical axial sections, with the liners in elevation, through parts of further pipes.
Figure 13:
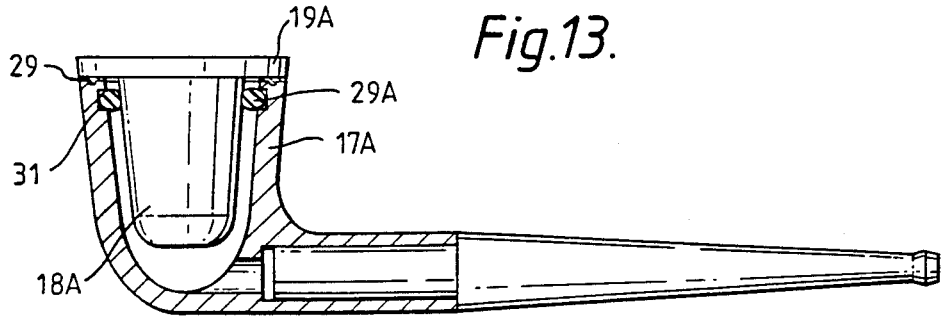

FIGS. 12 and 13 show two versions of an alternative construction in which the axis of the bowl and liner is perpendicular to that of the stem. In FIG. 12 the liner 18A and bowl 17A are held relatively to one another by an O-ring 29A which is located in annular grooves 31 and 32 in the bowl 17A and liner 18A, respectively. The adhesive 29 is, in this case, optional as the ring 29A holds the liner in the bowl and seals the top of the space 23. In FIG. 13 there is no groove in the liner and the use of the high temperature adhesive ring 29 between the liner flange 19A and rim of bowl is necessary if dismantling is to be inhibited. In both the FIGS. 12 and 13 constructions, the O-ring 29A centres the liner in the bowl like the lugs 21, 21A in the first example.

Figure 14:
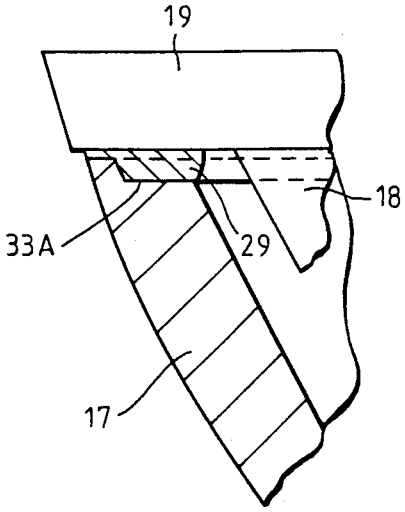

FIGS. 2, 5, 6, 12 and 13 show an annular groove 33 in the upper surface of the rim 20. This groove becomes filled with adhesive 29 upon assembly. However, if the radial thickness of the rim 20 is small, say less than 3 mm, the groove 33 may be replaced by a radially inwardly opening annular recess 33A as shown in FIG. 14.

We claim:

1. In a smoker's pipe having a moulded plastics bowl with an elongate stem having a stem axis, and within said bowl, a refractory cup-shaped liner having a liner axis; said liner having a smoke outlet in a bottom thereof leading, via a smoke duct through said stem, to a mouthpiece of the pipe; said smoke duct lying on said stem axis and said smoke outlet lying on said liner axis; an upper edge of said liner being formed with an integral, radially outwardly projecting flange overlying an upper rim of said bowl; substantially the whole of said liner beneath said flange being held out of direct contact with said bowl with an annular thermally insulating zone therebetween, said zone being sealed at an upper end thereof: the improvement wherein said liner and stem are juxtapositioned such that said liner axis is inclined at an obtuse angle to said stem axis and intersects said stem axis at a point outside said liner and above a bottom of said bowl, said obtuse angle being such that the stream of smoke leaving said smoke outlet of said liner is bent through a shallow acute angle as it flows to said smoke duct, said bottom of said liner being spaced from said bottom of said bowl by a distance such that direct impingement of the flowing smoke stream on the bottom of the bowl is lessened or avoided and overheating of said plastics bowl prevented; said liner and said bowl being asymmetrical about said liner axis such that a plane defined by said upper rim of said bowl and upper edge of said liner is inclined to said liner axis and is substantially parallel to said stem axis, and wherein complementary lugs and notches are provided at an upper end of said liner and on said bowl to angularly locate said liner about said liner axis in a desired position relative to said bowl.

2. A pipe according to claim 1, wherein the portion of said liner beneath said flange is held out of direct contact with a surrounding wall of said bowl with an unobstructed annular air space therebetween forming said insulating zone.

3. A pipe according to claim 1 wherein one or more spacer lugs are provided immediately beneath said flange or adjacent to said upper rim of said bowl to center said liner in said bowl and inhibit tilting of said liner relative to said bowl.

4. A pipe according to claim 1, wherein an inner surface of said liner is provided around its circumference, at least at its upper part, with a plurality of spaced, axially extending ribs.

5. A pipe according to claim I, wherein said bowl and stem are moulded from a high temperature unfilled plastics material.

6. A pipe according to claim 1, wherein said liner is filled with a performed plug of smoking material.

7. A pipe according to claim I, in which the said thermally insulating zone contains an insulating material of the kind resulting from heating sodium silicate.

8. A pipe according to claim 1, wherein said upper end of said insulating zone is sealed by a resilient ring interposed between said bowl and said liner.

9. A pipe according to claim 8, wherein said flange of said liner is bonded to said upper rim of said bowl by a high temperature adhesive providing said resilient ring.

10. A pipe according to claim 8, wherein an annular recess is provided in, but spaced from the outer periphery of, said upper rim and receives a said resilient ring.

11. A pipe according to claim 8, wherein said resilient ring is provided by a performed O-ring compressed between, and located in grooves in, said bowl and liner.

* * * * *